US006753741B1

(12) United States Patent
Findikoglu et al.

(10) Patent No.: US 6,753,741 B1
(45) Date of Patent: Jun. 22, 2004

(54) DYNAMIC TIME EXPANSION AND COMPRESSION USING NONLINEAR WAVEGUIDES

(75) Inventors: Alp T. Findikoglu, Los Alamos, NM (US); Sangkoo F. Hahn, Los Alamos, NM (US); Quanxi Jia, Los Alamos, NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 66 days.

(21) Appl. No.: 09/985,522

(22) Filed: Nov. 5, 2001

Related U.S. Application Data

(60) Provisional application No. 60/250,240, filed on Nov. 30, 2000.

(51) Int. Cl.[7] ..... H01P 3/00
(52) U.S. Cl. ..... 333/20; 333/99 S
(58) Field of Search ..... 333/20, 161, 99 S; 505/210, 700, 866

(56) References Cited

U.S. PATENT DOCUMENTS

| | | | | |
|---|---|---|---|---|
| 5,066,928 A | * | 11/1991 | Ikezi et al. | 333/20 |
| 5,157,361 A | | 10/1992 | Gruchalla et al. | 333/20 |
| 5,604,375 A | | 2/1997 | Findikoglu et al. | 257/661 |
| 5,777,531 A | * | 7/1998 | Tran et al. | 333/161 X |
| 6,480,728 B1 | * | 11/2002 | Mansour | 333/20 X |

OTHER PUBLICATIONS

Findikoglu et al., "Comparative Study of Boradband Electrodynamic Properties of Single–Crystal and Thin–Film Strontium Titanate," Applied Physics Letters, vol. 75, No. 3, pp. 4189–4191, Dec. 27, 1999.

Findikoglu et al., "Electrodynamic Properties of Coplanar Waveguides Made from HIgh–Temperature Superconducting $YBa_2Cu_3O_{1-\delta}$Electrodes on Nonlinear Dielectric $SrTiO_3$ Substrates," Journal of Applied Physics, vol. 86, No. 3, pp. 1558–1568, Aug. 1, 1999.

Findikoglu et al., "Dynamic Time Expansion and Compression Using Nonlinear Waveguides," Applied Physics Letters, vol. 77, No. 22, pp. 3645–3647, Nov. 27, 2000.

Vendik et al., "Microwave Losses in Incipient Ferroelectrics as Functions of the Temperature and the Biasing Field," Journal of Applied Physics, vol. 84, No. 2, pp. 993–998, Jul. 15, 1998.

Findikoglu et al., "Pulse Shaping Using Nonlinear Dielectric $SrTiO_3$," vol. 74, No. 12, pp.–1770–1772, Mar. 22, 1999.

* cited by examiner

*Primary Examiner*—Benny Lee
(74) *Attorney, Agent, or Firm*—James C. Durkis; William C. Daubenspeck; Paul A. Gottlieb

(57) ABSTRACT

Dynamic time expansion or compression of a small-amplitude input signal generated with an initial scale is performed using a nonlinear waveguide. A nonlinear waveguide having a variable refractive index is connected to a bias voltage source having a bias signal amplitude that is large relative to the input signal to vary the reflective index and concomitant speed of propagation of the nonlinear waveguide and an electrical circuit for applying the small-amplitude signal and the large amplitude bias signal simultaneously to the nonlinear waveguide. The large amplitude bias signal with the input signal alters the speed of propagation of the small-amplitude signal with time in the nonlinear waveguide to expand or contract the initial time scale of the small-amplitude input signal.

9 Claims, 5 Drawing Sheets

DYNAMIC TIME EXPANSION AND COMPRESSION USING NONLINEAR WAVEGUIDES

RELATED CASES

This case claims the benefit of U.S. Provisional Application Ser. No. 60/250,240, filed Nov. 30, 2000.

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to the time compression and expansion of electrical signals, and, more particularly, to nonlinear wave guides for signal time compression and expansion.

BACKGROUND OF THE INVENTION

Fast signals with nanosecond duration pose a serious challenge for data acquisition. With the current prevalence of digital signal processing, it is usually an analog-to digital converter (ADC) in the chain of signal and data processing elements that creates a performance bottleneck. Once converted, there are abundant resources available in manipulating the data digitally for optimum results without having to worry about further degradation of the signal-to-noise ratio. Even with tremendous advances in semiconductor processing technology, commercial off-the-shelf ADCs are not quite fast enough to capture nano-second events.

ADCs with high conversion speeds based on optical sampling are being studied by various organizations but with limited success, mainly because of cumbersome and complex electro-optic components. The pace of developments in all of these ADCs, however, is slowing down as the technology matures. For a leap in performance, a fresh new technology is required.

In accordance with the present invention, nonlinear coplanar waveguide devices perform dynamic time expansion (DTE) and dynamic time compression (DTC) on fast broadband signals with nanosecond duration. DTE provides a preprocessing stage to time-expand a fast signal prior to digitizing by an analog-to-digital converter (ADC), whereas DTC provides a post-processing stage to time-compress the output of a digital-to-analog converter (DAC). DTE and DTC implementation will provide significant enhancements in detection and generation of fast signals with large bandwidths for communication and radar applications as well as in laboratory R&D environments.

Various features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention includes a system for dynamic time expansion or compression of a small-amplitude input signal that is generated with an initial time scale. A nonlinear waveguide having a variable refractive index is connected to a bias voltage source having a bias signal amplitude that is large relative to the input signal to vary the refractive index and concomitant speed of propagation of the nonlinear waveguide and an electrical circuit for applying the small-amplitude signal and the large amplitude bias signal simultaneously to the nonlinear waveguide. The large amplitude bias signal with the input signal alters the speed of propagation of the small-amplitude signal with time in the nonlinear waveguide to expand or contract the initial time scale of the small-amplitude input signal.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

A DTE (and corolary DTC) according to the present invention achieves improved performance with a new approach to dynamic compression and expansion of signals. As described herein, when a dielectric medium of a waveguide is partly occupied by a nonlinear dielectric thin film (such as a ferroelectric or a paraelectric). the application of a "large" electric field in the film leads to a change in the refractive index of the material, or, equivalently, to a change in propagation speed of electromagnetic waves in the waveguide. Thus, by combining a small-amplitude signal together with a large-amplitude bias voltage (such as a time varying ramp or a static direct current (DC) bias voltage) that alters the effective refractive index of the waveguide, the small-signal is either expanded or compressed in the time domain. In other words, using a nonlinear dielectric medium as a part of a coplanar waveguide (CPW) structure enables the electrical length of the signal path to be dynamically adjusted to form a variable delay line in the time domain.

Figure 1A:
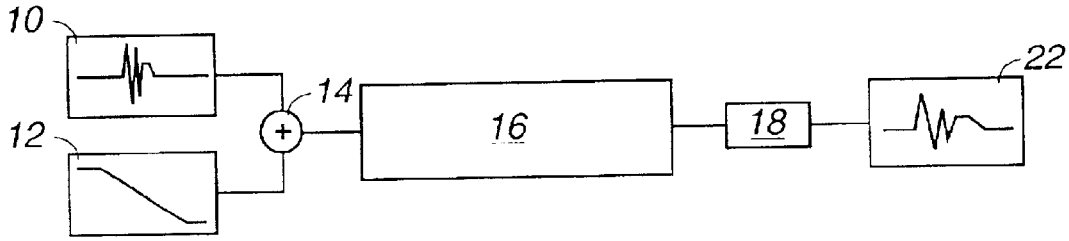
FIGS. 1A and 1B depict in block diagram form systems for dynamic time expansion (DTE) and dynamic time compression (DTC) according to one embodiment of the present invention.

A simplified schematic demonstrating DTE in accordance with the present invention is shown in FIG. 1A. An input signal waveform is provided from signal source 10 and is combined with a decreasing bias voltage signal from a signal generator 12, such as a ramp voltage, that has a large amplitude relative to the input signal. Input signal source 10 and bias signal generator 12 are connected to adder 14 for producing a composite signal for input to nonlinear waveguide 16. The decreasing bias signal acts to allow the front edge of the waveform to propagate with minimum delay while progressively delaying successive parts of the input signal. The time expanded signal is input to high pass filter 18 and output to signal processor 22. Each segment of the time expanded signal maintains the same relative amplitude, but expanded in scale with time.

Figure 1B:
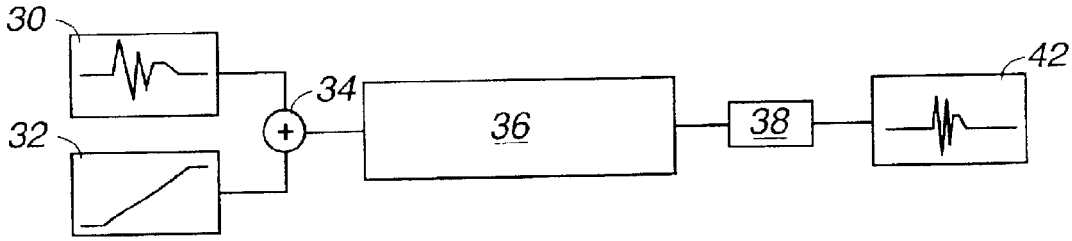

A corresponding DTC is shown in FIG. 1B. An input signal waveform is input from signal source 30, which may be a processor of a time expanded signal, and combined with an increasing bias voltage from signal generator 32, which may be a ramp voltage, that has an amplitude that is large relative to the input signal. The input signal and bias voltage are input to adder 34, which outputs a composite signal to nonlinear waveguide 36. The increasing signal bias allows the front edge of the waveform to propagate with minimum increase in propagation speed while progressively increasing the propagation speed of succeeding parts of the signal. The time compressed signal is output through high pass filter 38 to processor 42. In an exemplary application, the DTC is used to restore the original waveform time spacing from the processed waveform that is output from the DTE shown in FIG. 1A for use in high speed digital to analog converters (DACs) or in radar applications.

Figure 2A:
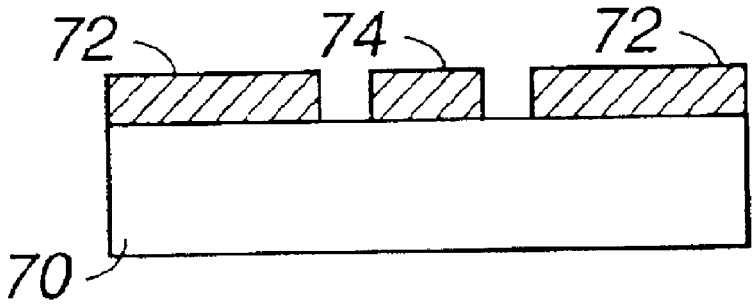
FIGS. 2A and 2B are cross-sectional representations of exemplary nonlinear coplanar waveguides useful in the present invention.
Figure 2B:
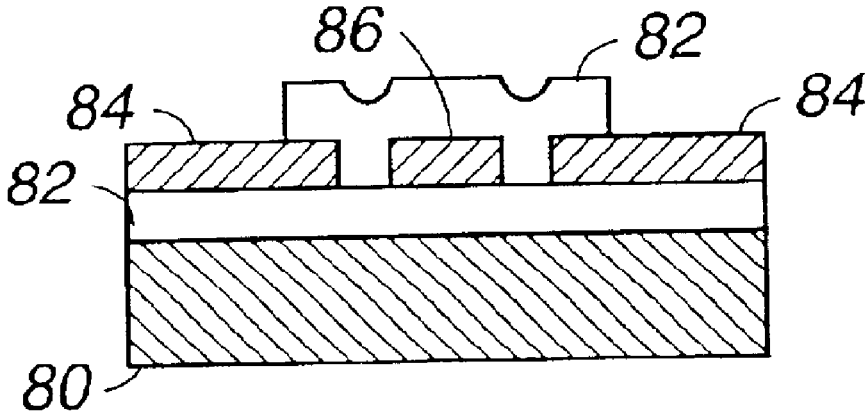

Exemplary nonlinear coplanar waveguides are shown in FIGS. 2A and 2B with superconducting $YBa_2Cu_3O_7$ (YBCO) thin-film electrodes 72/74 and 84/86, respectively. Two types of nonlinear dielectrics were used: single-crystal 70 and bi-layer film 82 $SrTiO_3$ (STO). Both devices had identical electrode structures 72/74 and 84/86, made from 0.4-$\mu$m-thick epitaxial YBCO films, patterned in the form of 7.8-cm-long meandering CPWs with approximately a 20-$\mu$m-wide centerline and 15-$\mu$m-wide gap on 8 mm×8 mm templates. The single-crystal sample used, as nonlinear dielectric medium, a 1-mm-thick single-crystal STO substrate 70 (commercially obtained from K&R Creation) below the electrodes 72/74. The bi-layer device used 0.7-$\mu$m-thick epitaxial STO films (crystallograhic plane (100)) 82 below and above the electrodes 84/86, pulsed-laser-deposited on 0.5-mm-thick single-crystal $LaAlO_3$ (100) (crystallographic plane (100)) substrates 80. The details of linear and nonlinear electrodynamic properties of similar waveguides may be found in A. T. Findikoglu, Q. X. Jia. C. Kwon, D. W. Reagor, K. O. Rasmussen, and A. R. Bishop, Appl. Phys. Lett. 75, 4189 (1999). A, T. Findikoglu, D. W. Reagor, K. O. Rasmussen, A. R. Bishop, N. Gronbech-Jensen, Q. X. Jia, Y. Fan, and C. Kwon, Appl. Phys. Lett. 74, 1770 (1999). and A. T. Findikoglu, D. W. Reagor, K. O. Rasmussen, A. R. Bishop, N. Gronbech-Jensen, Q. X. Jia, Y. Fan, C. Kwon and L. A. Ostrovsky, J. Appl. Phys. 86, 1558 (1999).

Since DTE/DTC according to the present invention is based on imposing different delays to different parts of a short pulse, in principle, the expansion/compression factor, which is proportional to the length of the nonlinear waveguide, could be indefinitely large. In practice, however, the expansion/compression factor is limited by the dissipation and dispersion in the nonlinear medium. Also, due to large-signal propagation along the waveguide, the DTE/DTC device will unavoidably lead to some distortion of a small-signal shape. All these effects can be taken into account in the digital processing stage. A nonlinear wave equation that accurately describes such nonlinear, dispersive, and dissipative effects in similar waveguide structures (See A. T. Findikoglu et. al. Appl. Phys. Lett. 75, 4189(1999) is given by $$\frac{\partial v_s}{\partial x} + u(v_{dc} + v_s)\frac{\partial v_s}{\partial x} = \left(\alpha\frac{\partial}{\partial x} + \beta\frac{\partial^2}{\partial^2 x}\right)H\{v_s\} \tag{1}$$

where $u(v_{dc}+v_s)$ is the voltage dependent velocity, $v_{dc}$, is the bias voltage, $v_s$ is the signal voltage, and $H\{v_s\}$ denotes the Hilbert transform. The frequency-dependent loss and the frequency-dependent refractive index are given by $\alpha\partial H\{v_s\}/\partial x$ and $\beta\partial^2 H\{v_x\}/\partial x^2 H\{v_s\}$, respectively, where $\alpha$ and $\beta$ are constants.

Figure 3A:
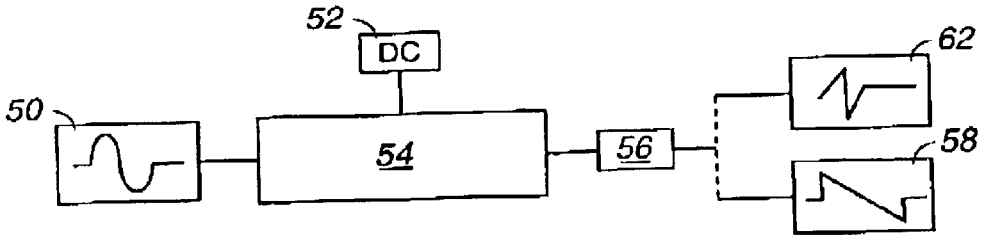
FIG. 3A depicts in block diagram form a system for dynamic time DTE and DTC of a bi-pulse using a DC bias voltage according to another embodiment of the present invention.

An initial demonstration of DTE and DTC according to the present invention used nonlinearity due to an external DC bias and the signal itself, instead of an added ramp signal. Thus, the signal distortion is larger than it would be with a ramp. A DC bias circuit is shown in block diagram form in FIG. 3A. An input signal, such as a bi-pulse (a two pulse signal having a positive and a negative pulse) or the like, is output by signal source 50 to nonlinear dielectric waveguide 54. DC bias voltage source 52 is connected to nonlinear dielectric waveguide 54, where a bias voltage can be applied that is large in amplitude relative to the input signal. A time expanded/contracted signal is output through high pass filter 56 A positive (+) voltage bias produced a time expanded output signal 58 and a negative (−) voltage produced a time compressed output signal 62, as explained below.

Figure 3B:
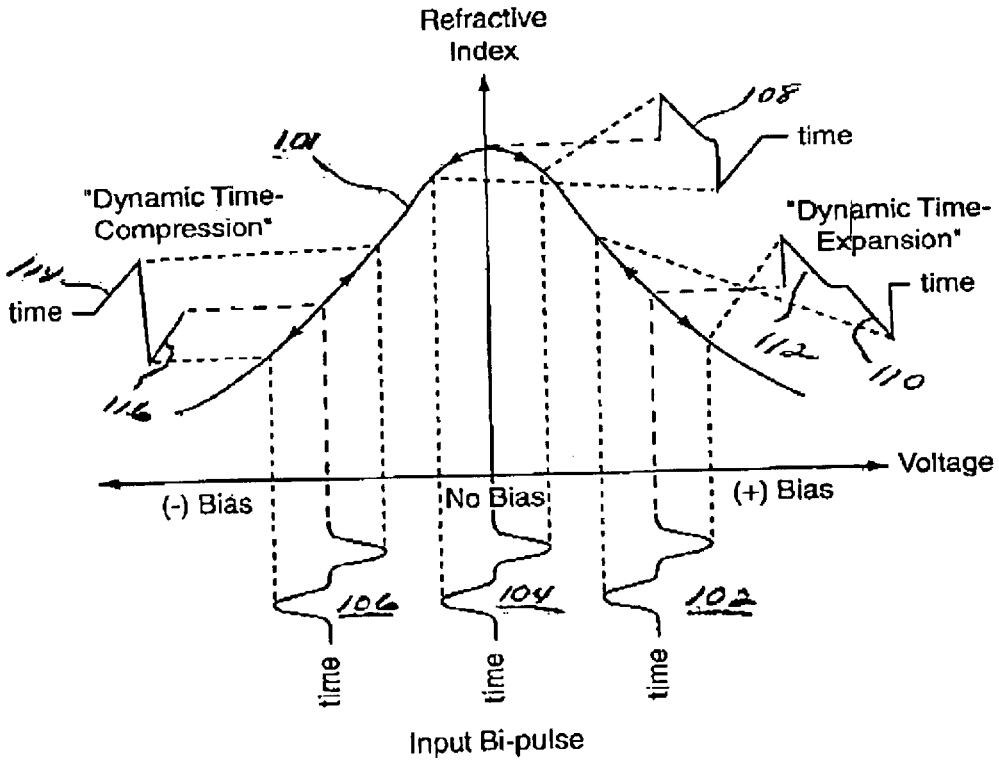
FIG. 3B graphically illustrates DTE and DTC for bi-pulse signals using a waveguide with nonlinear refractive index.

FIG. 3B schematically depicts how the nonlinearity of the refractive index 101 leads to DTE and DTC for bi-pulse signals 102, 104 and 106, in which the leading pulse is negative-going and the trailing pulse is positive-going, under (+), (No) and (−) DC bias, respectively. For the case of no DC bias, the nonlinearity of the refractive index 101 provides similar effects on both the negative-going and positive-going portions of bi-pulse 104 so that there is neither DTE or DTC as illustrated by curve 108. In the case of (+) bias, the superposition of the bi-pulse and the bias leads to an effective "high" bias for the leading pulse and "low" bias for the trailing pulse, illustrated by curves 110 and 112, respectively. Thus, the leading pulse experiences a lower effective refractive index, and consequently faster propagation compared to the trailing pulse. As a result, the bi-pulse is stretched in the time domain, i.e., undergoes DTE. On the other hand, the (−) bias leads to the reverse effect—the leading pulse experiences a higher effective index of refraction and the bi-pulse 106 is compressed, i.e., undergoes DTC, as illustrated by curves 114 and 116, respectively.

Figure 4A:
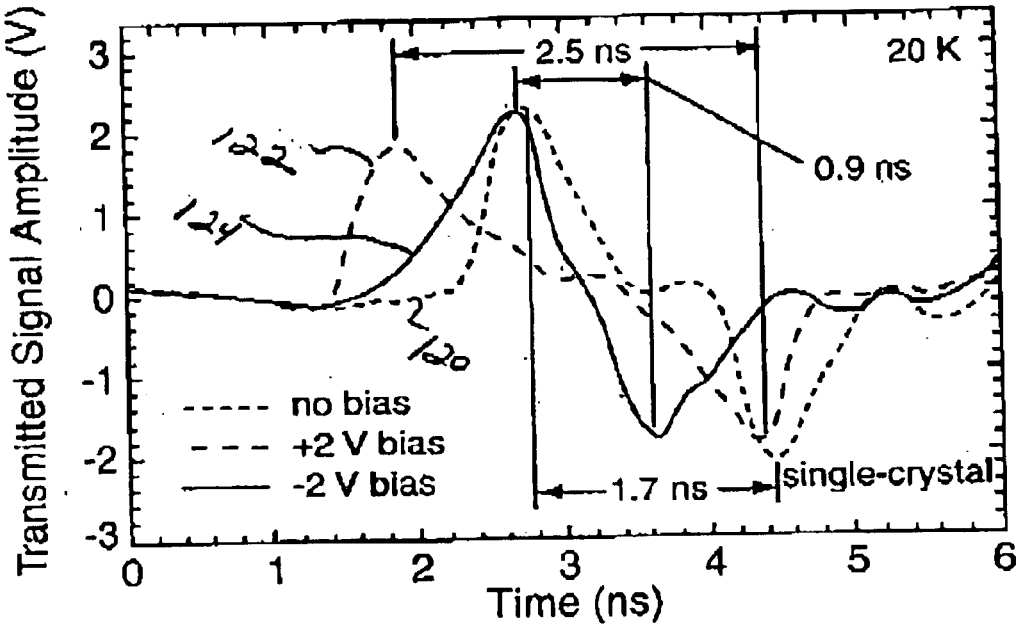
FIGS. 4A and 4B graphically depict experimental data for transmitted bi-pulse signal amplitudes vs. time for a signal-crystal waveguide shown in FIG. 2A at 20 K with 0, −2, +2 V bias conditions, and a bi-layer waveguide shown in FIG. 2B at 40 K with 0, +8 V bias conditions, respectively.
Figure 4B:
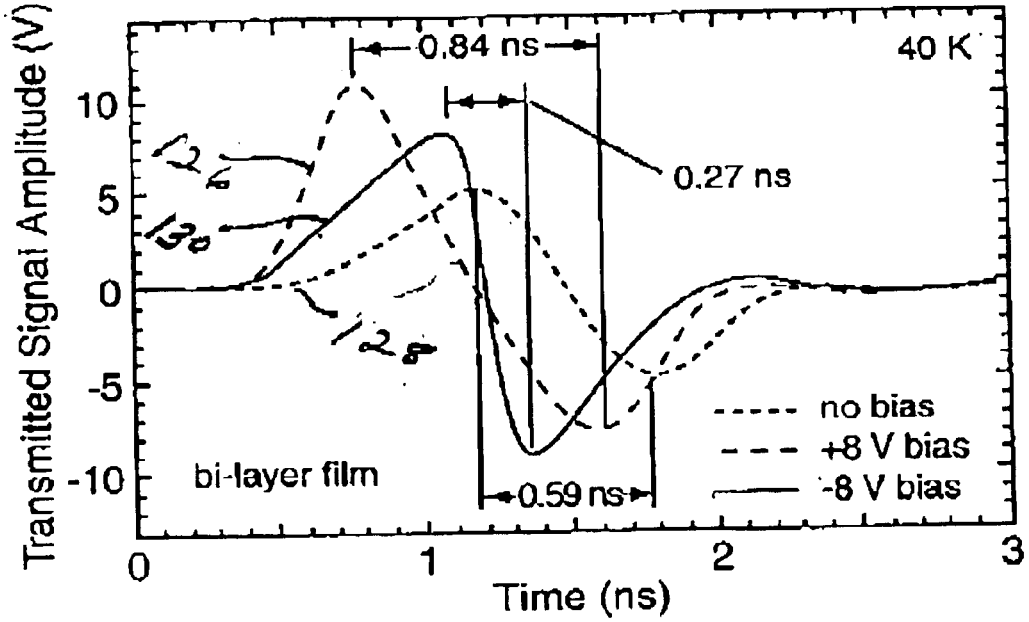

FIGS. 4A and 4B show the experimental results on bi-pulse DTC and DTE. The input bi-pulses were generated by adding the negative and positive outputs of an impulse generator (Picosecond Pulse Labs, Model 1000) by appropriate delays. As illustrated in FIG. 4A, the bi-pulse used for a single-crystal nonlinear dielectric waveguide had a peak-to-peak voltage amplitude of about 40 V and peak-to-peak separation of about 1.7 ns. As illustrated in FIG. 48, the bi-pulse used for a bi-layer film nonlinear dielectric waveguide had a peak-to-peak voltage amplitude of about 30 V and peak-to-peak separation of about 0.59 ns., Due to large impedance mismatch between a 50-Ω external circuit and low-impedance (~2–10 Ω) waveguides, the transmission coefficient was low for both devices, yielding transmitted peak-to-peak amplitudes of about 4 V for the single-crystal and about 10 V for the bi-layer-film waveguides. Nonlinearity of the single-crystal waveguide degraded appreciably with increasing temperature above 20 K, whereas the bi-layer waveguide characteristics were essentially unchanged between 20 and 60 K (see A. T. Findikoglu et. al. Appl. Phys. Lett. 75, 4189 (1999).

As shown in FIG. 4A, in the single crystal nonlinear dielectric waveguide, a bi-pulse with no bias illustrated by curve 120 had a peak-to peak time of 1.7 ns, a bi-pulse with +2 bias illustrated by curve 122 had a peak time of 2.5 ns, and a bi-pulse with a −2 bias illustrated by curve 124 had a peak to peak time of 0.9 ns. If DTC and DTE expansion and compression factors are defined as the percentage change from initial peak-to-peak time to the peak-to-peak time after bias is applied, then, as shown in FIG. 4A, a controllable dynamic delay of about 0.8 ns in the case of the single-crystal waveguide with an input of 1.7-ns bi-pulse yields DTC of about −50% and DTE of about +50%.

As shown in FIG. 4B, for the bilayer waveguide, a bi-pulse with no bias illustrated by curve 126 had a peak-to peak time of 0.84 ns, a bi-pulse with +8bias illustrated by curve 128 had a peak to peak time of 0.59 ns, and a bi-pulse with a −8 bias illustrated by curve 130 had a peak to peak time of 0.27 ns. With a controllable dynamic delay of about 0.3 ns, an input of 0.59-ns bi-pulse provides about +50% DTE and −50% DTC.

Figure 5A:
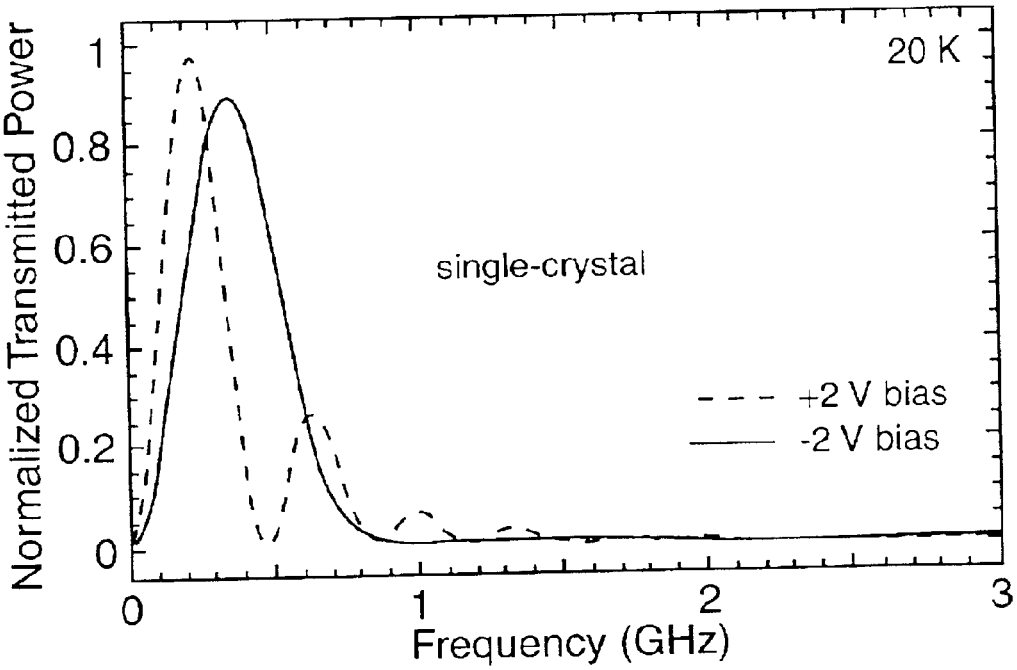
FIGS. 5A and 5B graphically depict spectral power for a bi-pulse transmitted through the single-crystal waveguide at 20 K under −2 and +2 V bias and the bi-layer waveguide at 40 K under −8 and +8 V bias, respectively.
Figure 5B:
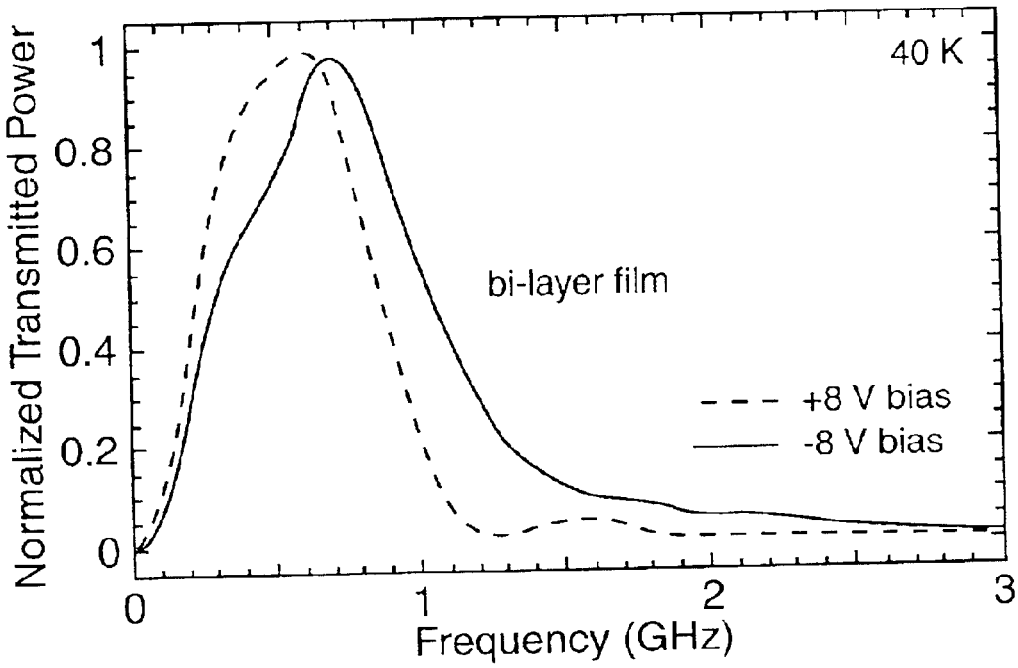

With bias, the dielectric loss in STO films decreases while it increases in single-crystals of STO (See O. G. Vendik, L. T. Ter-Martirosyan, S. P. Zubko, J. Appl. Phys. 84, 993 (1998) and A. Tagantsev, Appl. Phys. Lett, 76, 1182 (2000).) Thus, in either device, it is not possible to do a simple comparison in the frequency content of the signal before and after bias is applied. Nevertheless, direct Fourier analysis comparison can be made between the (+) and (−) bias conditions since the electrodynamic properties of the waveguides are symmetric with respect to polarity of bias. FIGS. 5A and 5B show the results of such Fourier analysis wherein the solid curves illustrate the Fourier analysis of the waveform with DTC and the dashed curve illustrates the Fourier analysis of the waveform with DTE, for the single crystal waveguide and the bimetal film waveguide respectively. In both waveguides, the lowest frequency peak (corresponding to the time-domain separation of leading and trailing pulses of the bi-pulse) clearly moves to higher frequency with DTC. This again confirms that the observed DTC and DTE effects are of nonlinear origin and are not due to some linear dispersive effects.

In summary, the present invention provides a technique to compress (by DTC) and stretch (by DTE) short electromagnetic signals in time-domain. The 7.8-cm-long waveguides that use nonlinear dielectric STO with superconducting YBCO electrodes yielded about −50% DTC and +50% DTE on input bi-pulses with about 1-ns peak-to-peak separation. Further implementation of the DTE/DTC concept includes incorporation of impedance matching circuitry in the device, development of an external circuitry that can synchronize and add a large-amplitude ramp signal and an arbitrary small-amplitude short signal, and detailed characterization and modeling of the strong nonlinearity and related signal distortion in these devices.

The foregoing description of dynamic time expansion and contraction of small signals according to the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A system for dynamic time expansion or compression of a small-amplitude input signal generated with an initial time scale comprising:

a nonlinear waveguide having a variable refractive index;

a bias voltage that has an amplitude which is large relative to the small amplitude input signal to vary with time the refractive index and concomitant speed of propagation of an electrical signal in the nonlinear waveguide with time; and an electrical circuit for applying the small-amplitude signal and the large amplitude bias voltage simultaneously to the nonlinear waveguide to alter the speed of propagation of the small-amplitude signal with time in the nonlinear waveguide to expand or contract the initial time scale of the small-amplitude input signal.

2. The system according to claim 1, wherein the bias voltage source is a ramp signal generator.

3. The system according to claim 1, wherein the input signal is a bi-pulse and the bias voltage is a DC voltage.

4. The system according to claim 1, wherein the nonlinear waveguide includes superconducting electrodes deposited over a nonlinear dielectric material.

5. A method for dynamic time expansion or compression of a small-amplitude input signal comprising:

inputting a bias signal having an amplitude that is large relative to the small-amplitude input signal to a nonlinear waveguide simultaneously with the small-amplitude input signal, where the bias signal is effective to vary a refractive index of the nonlinear waveguide with time to alter a speed of propagation of the small-amplitude input signal in the nonlinear waveguide.

6. The method according to claim 5, wherein the bias signal is a ramped signal having a positive slope to expand the small-amplitude input signal or a negative slope to compress the small-amplitude input signal.

7. The method according to claim 5, wherein the small-amplitude input signal is a bi-pulse and the bias signal is a DC voltage.

8. The method of claim 5 further comprising filtering the bias signal from an output of the nonlinear waveguide to provide the expanded or compressed small amplitude signal.

9. The system of claim 1 further comprising:

filter means coupled to an output of said nonlinear waveguide for removing the large amplitude bias voltage from an electrical signal that has propagated in said nonlinear waveguide.

* * * * *